US008651707B1

(12) United States Patent
Tang et al.

(10) Patent No.: US 8,651,707 B1
(45) Date of Patent: Feb. 18, 2014

(54) OPTICAL LENS FOR A LED HAVING A QUASI-ELLIPTICAL SHAPE

(71) Applicants: Ledlink Optics, Inc., New Taipei (TW); Ledlink Optics (Dong Guan) Co., Ltd., Guangdong (CN); Yang Zhou Ledlink Optics Co., Ltd., Jiangsu Province (CN)

(72) Inventors: Te-Lung Tang, New Taipei (TW); Chih-Ming Wei, New Taipei (TW)

(73) Assignees: LedLink Optics, Inc., New Taipei (TW); LedLink Optics (Dong Guan) Co., Ltd., Guangdong (CN); Yang Zhou LedLink Optics Co., Ltd., Jiangsu Province (CN)

( * ) Notice: Subject to any disclaimer, the term of this patent is extended or adjusted under 35 U.S.C. 154(b) by 0 days.

(21) Appl. No.: 13/788,501

(22) Filed: Mar. 7, 2013

(51) Int. Cl.
*F21V 5/04* (2006.01)

(52) U.S. Cl.
USPC ..... 362/311.02; 362/335

(58) Field of Classification Search
USPC ..... 313/501–512; 362/311.02, 335, 555, 362/309–310, 249.02
See application file for complete search history.

(56) References Cited

U.S. PATENT DOCUMENTS

| | | | | |
|---|---|---|---|---|
| 6,061,160 | A * | 5/2000 | Maruyama | 398/201 |
| D670,010 | S * | 10/2012 | Lin | D26/1 |
| 2010/0302785 | A1* | 12/2010 | Zhou | 362/311.02 |
| 2011/0019425 | A1* | 1/2011 | Chen et al. | 362/311.02 |
| 2013/0201693 | A1* | 8/2013 | Tang | 362/335 |
| 2013/0250581 | A1* | 9/2013 | Tang et al. | 362/311.02 |

* cited by examiner

*Primary Examiner* — Tracie Y Green
(74) *Attorney, Agent, or Firm* — Rosenberg, Klein & Lee

(57) ABSTRACT

Disclosed is an optical lens for guiding light of an LED to produce a quasi-elliptical light pattern, and the optical lens has a lens body. The optical lens comprises an emitting surface and an incident surface. The emitting surface is a curved surface, and an illumination side of the emitting surface is in a quasi-elliptical shape with a long axis and a short axis, and the length of the long axis is a, and the length of the short axis is b, and the lens body has a lens height c. The length a of the long axis, the length b of the short axis, and the lens height c satisfy the relations of $1<a/b\leq 1.67$ and $2\leq a/c\leq 6$. Therefore, an LED backlight source or a general illumination with a wide scope of applicability, a reduced number of LEDs and an improved illuminating uniformity.

7 Claims, 7 Drawing Sheets

2

OPTICAL LENS FOR A LED HAVING A QUASI-ELLIPTICAL SHAPE

BACKGROUND OF THE INVENTION

1. Field of the Invention

The present invention relates to the field of illumination, and more particularly to an optical lens that guides an LED light and projects a quasi-elliptical light pattern, and the optical lens is applied in backlight modules or advertising billboards.

2. Description of the Related Art

Light emitting diode (LED) with the features of low power consumption, high performance and long life is used extensively in the area of lamps or backlight modules for illumination in recent years. However, LED emits light with a divergent angle smaller that that of a conventional light source, so that the number of LEDs used in an illumination lamp must be increased.

As to the backlight modules, the LEDs are installed on a light strip to emit light and provide a dot light source, but the light emitting range of the LEDs is directional, so that it is necessary to adjust the emitting light to a required range to fit its application on the backlight modules. Therefore, it is an important subject for related manufacturers to improve the intensity, the range and the uniformity of the illumination of the LED light source.

To meet market requirements, it is necessary to provide an optical lens that guides an LED light and projects a quasi-elliptical light pattern with the best illumination status in different using conditions, and it has become an urgent issue in the application market.

SUMMARY OF THE INVENTION

In view of the problems of the prior art, it is a primary objective of the present invention to overcome the problems by an optical lens capable of guiding the light of an LED to produce a quasi-elliptical light pattern, and the optical lens is applicable in a backlight module to reduce the number of light strips.

To achieve the aforementioned objective, the present invention provides an optical lens for guiding light of an LED to produce a quasi-elliptical light pattern, and the optical lens has a lens body. The optical lens comprises an emitting surface and an incident surface. The emitting surface is a curved surface having an illumination side substantially in a quasi-elliptical shape, a long axis and a short axis, wherein the long axis has a length a, and the short axis has a length b, and the short axis is perpendicular to the long axis, and the emitting surface has a center position with a vertex P. In addition, the incident surface has a bottom surface and a concavely curved surface, and the concavely curved surface is for containing the LED, and the incident surface is coupled to the emitting surface to form an external surface of the lens body. The lens body has a lens height c, and the length a of the long axis, and the length b of the short axis, and the lens height c satisfy the relations of: $1<a/b\leq 1.67$; and $2\leq a/c\leq 6$.

To achieve the effect of adjusting the emitting light with different quasi-elliptical pattern, the bottom surface has a serrated structure, a dot structure, a hazy structure or any combination of the above to improve the applicability of different using status or environments.

In the present invention, an accommodating chamber with the concavely curved surface is concavely formed at the incident surface of the lens body and provided for containing the LED, and the periphery of the concavely curved surface is enclosed to form a circular opening or a quasi-elliptical shaped opening. Since different shapes of the opening determines the distance and the angle of a light source that enters into the lens body, so as to change the path and performance of the emitting light and further adjust the effect and the uniformity of the emitting light.

The optical lens of the present invention further comprises an external wall disposed around the lens body, and a surface of the external wall has a dot structure or a hazy structure. The optical lens further comprises a plurality of column bases, and the column bases are disposed at a bottom of the external wall. In the process of installing the LED such as the assembling process of the backlight module, a portion of the end product can be installed or loaded quickly.

Preferably, a plane, a concave cambered surface or a convex cambered surface is formed on a center surface of the emitting surface of the optical lens of the present invention. By adjusting the aforementioned different structures, the LED light source at the emitting surface generally shows different light illumination effects of divergence or focusing.

In the present invention, a center position of the concavely curved surface and the vertex position of the emitting surface vary in the same direction in a one-dimensional spatial coordinate. Therefore, the invention still can prevent the transmission path of a light track in the lens body from being over-diverged and prevent the intensity of the target illumination area from being affected by a change of the size or a slight change of the structure of the optical lens.

DETAILED DESCRIPTION OF THE PREFERRED EMBODIMENTS

The technical content of the present invention will become apparent with the detailed description of preferred embodiments and the illustration of related drawings as follows. It is noteworthy that same numerals used in the following preferred embodiments and related drawings represent respective elements of the invention.

Figure 1A:
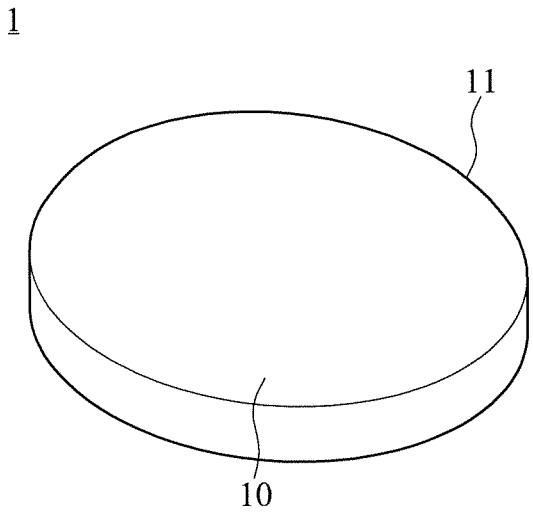
FIG. 1A is a perspective view of an optical lens of a first preferred embodiment of the present invention.
Figure 1B:
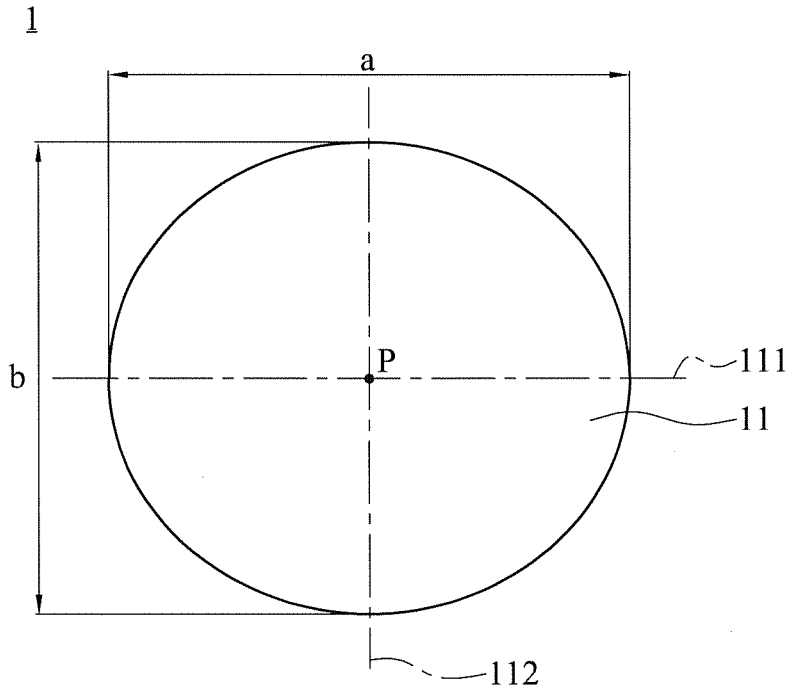
FIG. 1B is a top view of an optical lens of the first preferred embodiment of the present invention.
Figure 1C:
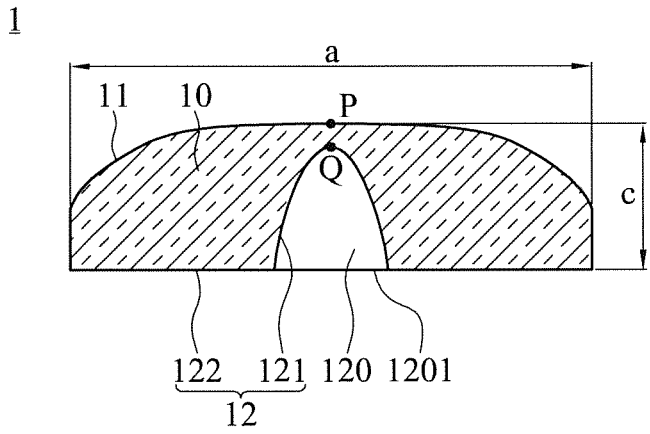
FIG. 1C is a cross-sectional view of an optical lens of the first preferred embodiment of the present invention.

With reference to FIGS. 1A, 1B and 1C for a perspective view, a top view and a cross-sectional view of an optical lens 1 in accordance with the first preferred embodiment of the present invention respectively, the optical lens 1 has a lens body 10, and the optical lens is provided for guiding light of an LED (not shown in the figure) to produce a quasi-elliptical light pattern. The optical lens 1 comprises an emitting surface 11 and an incident surface 12. The emitting surface 11 is a curved surface, and an illumination side of the emitting surface 11 is in a quasi-elliptical shape with a long axis 111 and a short axis 112, and the length of the long axis 111 is a1, and the length of the short axis 112 is b1, and the short axis 112 is perpendicular to the long axis 111, and a center position of the emitting surface has a vertex P situated on a surface of the emitting surface 11. The incident surface 12 has a concavely curved surface 121 and a bottom surface 122, and the incident surface 12 is coupled to the emitting surface 11 to form an external surface of the lens body 10. The lens body 10 has a lens height c.

Wherein, the length a1 of the long axis, the length b1 of the short axis, and the lens height c of the present invention preferably satisfy the following relations:

$$1<a1/b1\leq 1.67;\text{ and}$$

$$2\leq a1/c\leq 6.$$

Wherein, the relation between a1 and b1 is to maintain the quasi-elliptical shaped light pattern and the applicability in different environments effectively; and the relation between a1 and c is to control the overall illumination uniformity of the quasi-elliptical shaped light pattern, such that an illumination effect with a very high uniformity and a quasi-elliptical shaped light pattern can be achieved.

In this preferred embodiment, the optical lens 1 is manufactured according to the proportion of the long axis length a1:the short axis length b1:the lens height c or a:b:c=2.2:2:1.1, so as to achieve an effective illumination with a quasi-elliptical shaped light pattern, and the light pattern overlap or poor illumination efficiency can be reduced by connecting a plurality of adjacent quasi-elliptical shaped light patterns. Besides the improved illumination area and range, the present invention can also reduce the number of LEDs used and lower the cost of the end product significantly.

Figure 2A:
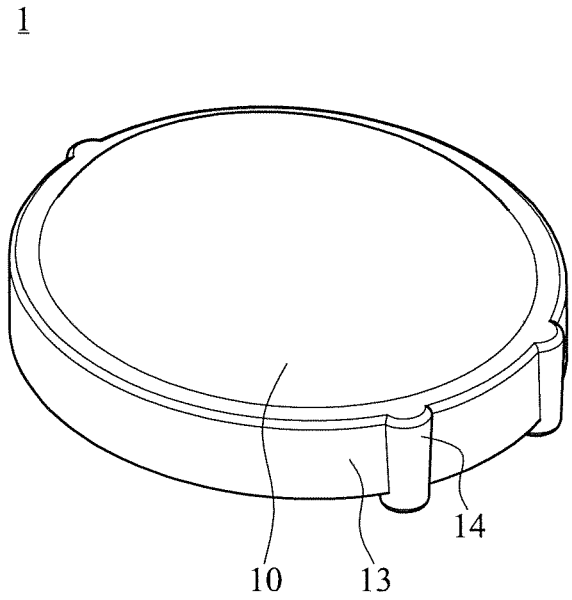
FIG. 2A is a perspective view of an optical lens of a second preferred embodiment of the present invention.
Figure 2B:
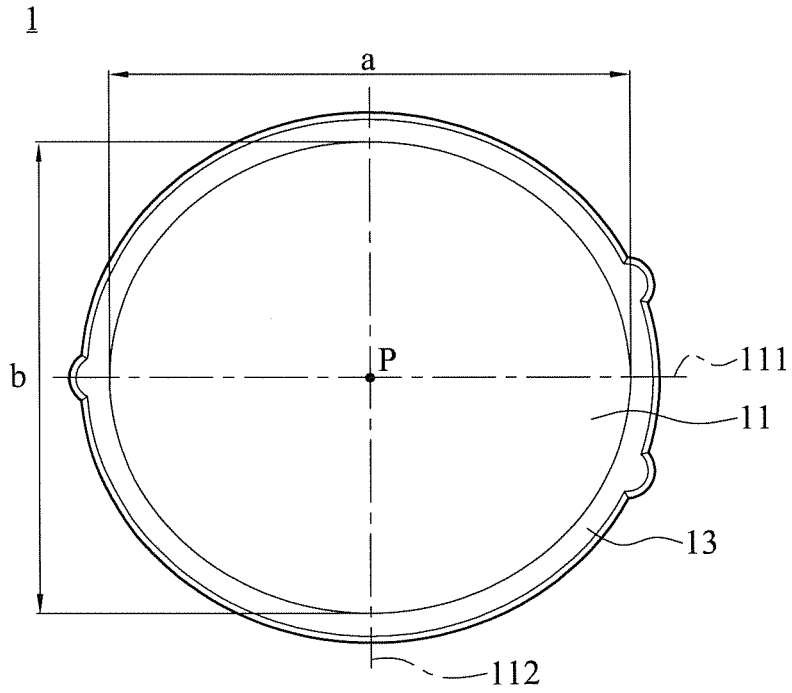
FIG. 2B is a top view of an optical lens of the second preferred embodiment of the present invention.
Figure 2C:
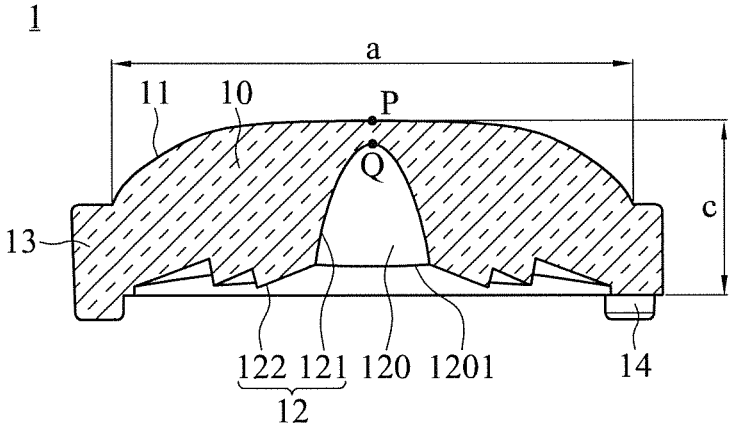
FIG. 2C is a cross-sectional view of an optical lens of the second preferred embodiment of the present invention.

With reference to FIGS. 2A, 2B and 2C for a perspective view, a top view and a cross-sectional view of an optical lens in accordance with the second preferred embodiment of the present invention respectively, the bottom surface 122 has a serrated structure, a dot structure, a hazy structure or any combination of the above to satisfy the applicability of different using statuses or environments. In this preferred embodiment, the bottom surface 122 comes with the serrated structure, but the invention is not limited to such arrangement only.

In the figures, an accommodating chamber 120 is concavely formed on the incident surface 12, and the accommodating chamber 120 has a concavely curved surface 121 capable of accommodating LEDs, and the periphery of the concavely curved surface 121 is enclosed to form an opening 1201, wherein the opening 1201 can be a circular opening or a quasi-elliptical opening. Since openings of different shapes determine the distance and the angle of a light source entering into the lens body, and the path of the emitting light is changed, therefore the effect and uniformity of the emitting light can be further adjusted. For example, if the LED emits a light source, the light source can be incident into the lens body 10 from the incident surface 12 and refracted through the concavely curved surface 121 and a serrated structure of the bottom surface 122 to adjust the track and direction of different lights, and then emitted from the emitting surface 11 to form a quasi-elliptical shaped light pattern.

It is noteworthy that a plane, a concave cambered surface or a convex cambered surface is formed at a center surface of the emitting surface 11. With the adjustment of different structures, the LED light source at the emitting surface provides an illumination effect with different divergent and focusing effects. In this preferred embodiment, a plane is formed at the center surface of the emitting surface 11, and the optical lens 1 further comprises an external wall 13 and a plurality of column bases 14, wherein the external wall 13 is disposed around the lens body 10, and a dot structure or a hazy structure is formed on a surface of the external wall 13, and the column bases 14 are disposed at a bottom of the external wall 13. In the process of installing the LED such as an assembling process of a backlight module, a portion of an end product can be installed or loaded quickly.

Based on the first and second preferred embodiment, a third preferred embodiment of the present invention is further provided for illustrating the invention.

Figure 3A:
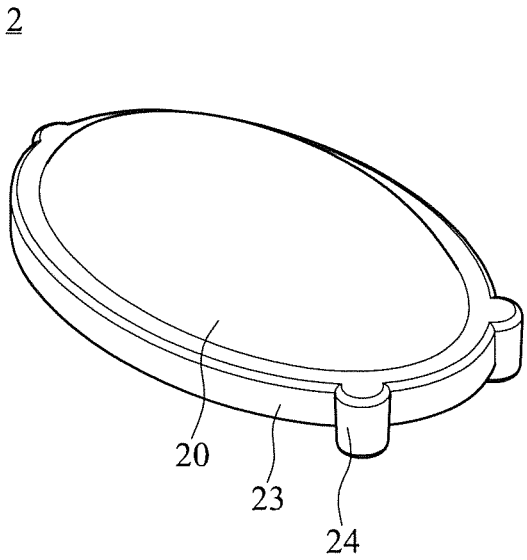
FIG. 3A is a perspective view of an optical lens of a third preferred embodiment of the present invention.
Figure 3B:
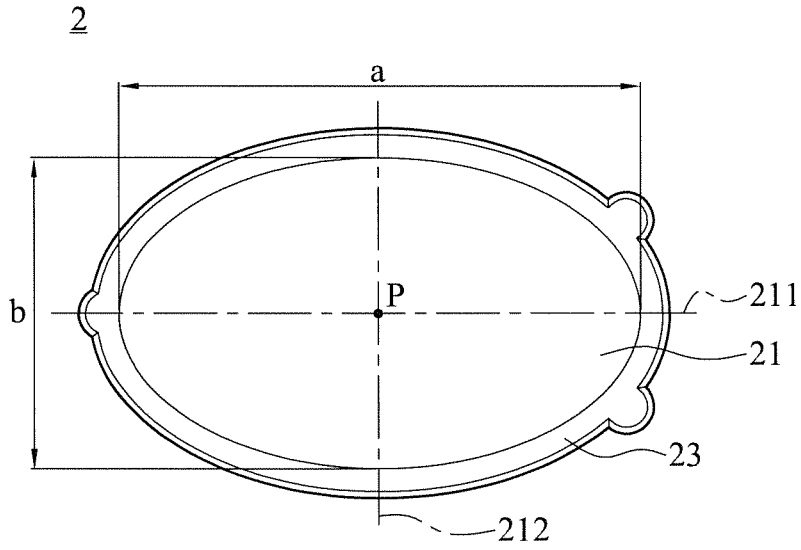
FIG. 3B is a top view of an optical lens of the third preferred embodiment of the present invention.
Figure 3C:
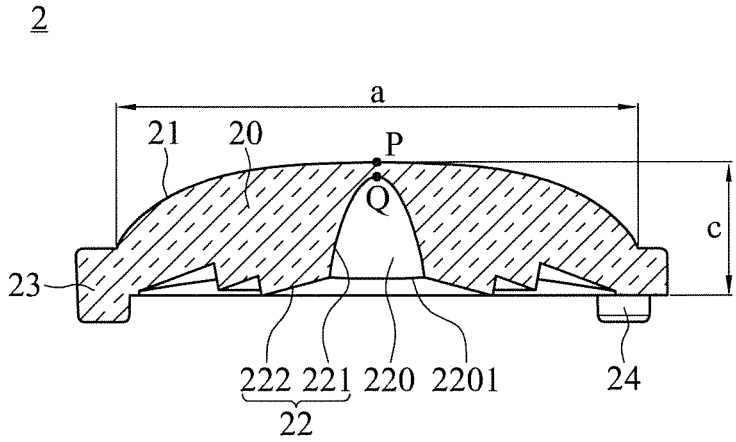
FIG. 3C is a cross-sectional view of an optical lens of the third preferred embodiment of the present invention.

With reference to FIGS. 3A, 3B and 3C for a perspective view, a top view and a cross-sectional view of an optical lens 2 in accordance with the third preferred embodiment of the present invention respectively, the optical lens 2 has a lens body 20, and the optical lens 2 comprises an emitting surface 21 and an incident surface 22. The emitting surface 21 is a curved surface, and an illumination side of the emitting surface 21 is in a quasi-elliptical shape with a long axis 211 and a short axis 212, wherein the long axis 211 has a length a2, and the short axis 212 has a length b2, and the short axis 212 is perpendicular to the long axis 211. In addition, the emitting surface 21 has a vertex P defined at a center position of the emitting surface 21, and the vertex P is situated on a surface of the emitting surface 21. The incident surface 22 has a concavely curved surface 221 and a bottom surface 222, wherein the concavely curved surface 221 is provided for containing and installing the LED, and the lens body 20 has a lens height c. The incident surface 22 and the emitting surface 21 are coupled to form an external surface of the lens body 20.

In the present invention, the long axis length a2, the short axis length b2 and the lens height c preferably satisfy the following relations:

$$1<a2/b2\leq 1.67;\text{ and}$$

$$2\leq a/c\leq 6.$$

Wherein, the relation between a2 and b2 is to maintain the quasi-elliptical shaped light pattern and the applicability in different environments effectively; and the relation between a2 and c is to control the overall illumination uniformity of the quasi-elliptical shaped light pattern, such that an illumination effect with a very high uniformity and a quasi-elliptical shaped light pattern can be achieved.

In this preferred embodiment, the optical lens 2 is manufactured according to the proportion of the long axis length a:the short axis length b:the lens height c or a:b:c=10.02:6:1.67. Compared with the foregoing preferred embodiments, this preferred embodiment further adjusts the effect of changing the quasi-elliptical shape. In other words, the difference between the long axis and the short axis (or the ratio of the long axis to the short axis) is greater. Even though the ratios of the long axis to the short axis of the quasi-elliptical shape of this preferred embodiment and the aforementioned embodiments are different, yet it is noteworthy that the position of a center point Q of the concavely curved surface 221 and the position of the vertex P of the emitting surface 21 vary in the same direction in a one-dimensional spatial coordinate. More specifically, the emitting surface 21 and the concavely curved surface 221 have a complementary relation. The greater the height of the emitting surface 21, the more concentrated is the light pattern. Provided that the size of the opening of the concavely curved surface 221 remains constant, the greater the height of the concavely curved surface 221, the more scattered is the light pattern. If the optical lens of the present invention is applied to a backlight light source, then the illumination range must be taken into consideration. To overcome the problems of the prior art, the bottom surface 222 serves as a reference surface, and the height of the emitting surface 21 is directly proportional to the height of the concavely curved surface 221 to obtain a better quasi-elliptical light pattern.

In this preferred embodiment, an accommodating chamber 220 with the concavely curved surface 221 is concavely formed on the incident surface 22 of the lens body 20 for containing and installing LEDs, and the position and height for installing each LED can be adjusted according to different requirements.

In addition, the accommodating chamber 220 on the concavely curved surface 221 is symmetrically formed with respect to the central axis linearly passing through the vertex P, so that the periphery of the concavely curved surface 221 can be enclosed to form a circular opening 2201, or the accommodating chamber 220 is asymmetrically formed, so that the periphery of the concavely curved surface 221 can be enclosed to form a quasi-elliptical opening 2201.

Therefore, the optical lens 2 of the present invention can guide the light of LED to project a quasi-elliptical light pattern. If the present invention is applied to a backlight module, the light pattern produced by the LED light strip of the backlight module is in a quasi-elliptical shape, so that the light pattern is distributed broader than that of the conventional circular light pattern, so that the invention can reduce the number of light strips used in the backlight module (or the material cost) and the manufacturing time and cost.

Figure 4A:
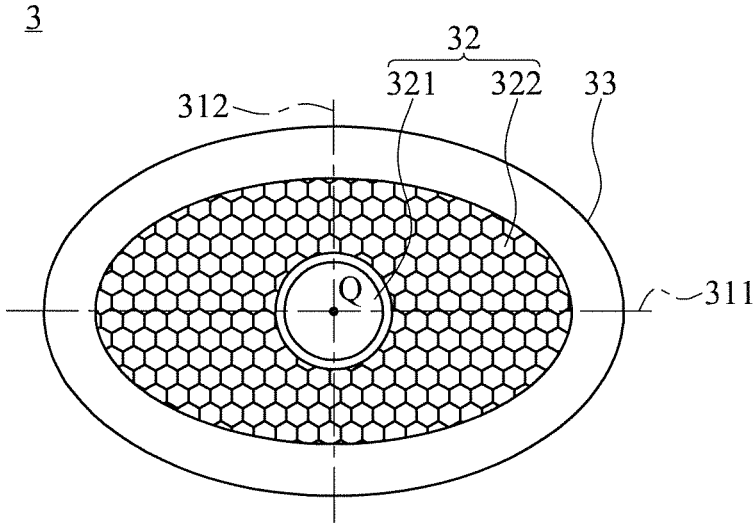
FIG. 4A is a bottom view of an optical lens of a fourth preferred embodiment of the present invention.
Figure 4B:
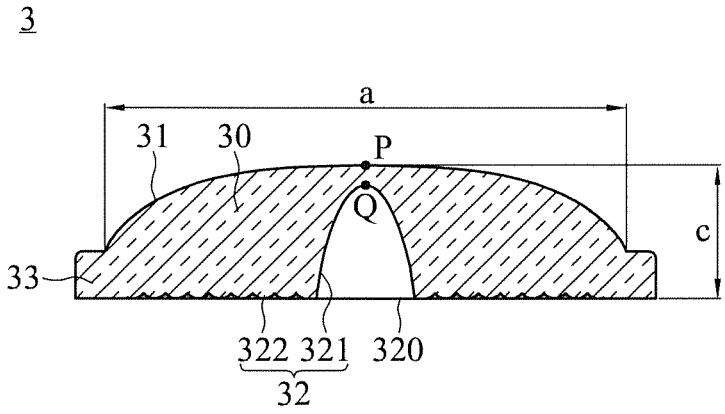
FIG. 4B is a cross-sectional view of an optical lens of the fourth preferred embodiment of the present invention.

With reference to FIGS. 4A and 4B for a bottom view and a cross-sectional view of an optical lens of the fourth preferred embodiment of the present invention respectively, the bottom surface 322 has a dot structure, a hazy structure or any combination of the above to meet the applicability for different using statuses or environments. In this preferred embodiment, the dot structure is formed on the bottom surface 322, but the invention is not limited to such arrangement only,

What is claimed is:

1. An optical lens, for guiding light of an LED to produce a quasi-elliptical light pattern, and the optical lens having a lens body, comprising:

an emitting surface, being a curved surface, and having an illumination side substantially in a quasi-elliptical shape, a long axis and a short axis, and the long axis having a length a, and the short axis having a length b, and the short axis being perpendicular to the long axis, and the emitting surface having a center position with a vertex P; and an incident surface, coupled to the emitting surface to form an external surface of the lens body, and having a concavely curved surface and a bottom surface, and the concavely curved surface being provided for containing the LED, and the lens body having a lens height c, and the length a of the long axis, and the length b of the short axis, and the lens height c satisfying the relations of $1<a/b\leq 1.67$ and $2\leq a/c\leq 6$.

2. The optical lens of claim 1, wherein the bottom surface has a serrated structure, a dot structure, a hazy structure or a combination thereof.

3. The optical lens of claim 1, wherein the concavely curved surface has a periphery enclosed into a circular opening or a quasi-elliptical opening.

4. The optical lens of claim 1, further comprising an external wall disposed around the lens body, and a surface of the external wall having a dot structure or a hazy structure.

5. The optical lens of claim 4, further comprising a plurality of column bases disposed at a bottom of the external wall.

6. The optical lens of claim 1, wherein the emitting surface is a plane, a concave cambered surface or a convex cambered surface formed at a center of emitting surface.

7. The optical lens of claim 1, wherein a center position of the concavely curved surface together with the vertex position of the emitting surface vary in the same direction in a one-dimensional spatial coordinate.

* * * * *